US007500574B1

(12) United States Patent
Miller, III et al.

(10) Patent No.: US 7,500,574 B1
(45) Date of Patent: Mar. 10, 2009

(54) COLLAPSIBLE RACK

(75) Inventors: Harmon B. Miller, III, Atlanta, GA (US); Wright Landrum Bunch, Tucker, GA (US)

(73) Assignee: DSM IP Holdings, Inc.

( * ) Notice: Subject to any disclaimer, the term of this patent is extended or adjusted under 35 U.S.C. 154(b) by 0 days.

(21) Appl. No.: 12/073,728

(22) Filed: Mar. 10, 2008

(51) Int. Cl.
*A47F 5/08* (2006.01)

(52) U.S. Cl. ..... 211/106; 211/149; 211/195

(58) Field of Classification Search ..... 211/106, 211/149, 150, 72, 73, 90.02, 85, 195, 81, 211/169, 126.6, 133.2, 130.1; 312/258, 261, 312/262; 108/115, 193
See application file for complete search history.

(56) References Cited

U.S. PATENT DOCUMENTS 1,724,385 A * 8/1929 Weston ..... 211/130.1
1,779,788 A * 10/1930 Weston ..... 211/130.1
2,680,522 A 6/1954 Temple
2,793,760 A 5/1957 Zel et al.
3,252,434 A 5/1966 Young, Jr.
3,863,575 A * 2/1975 Kuns et al. ..... 108/179
4,169,416 A 10/1979 Haynes et al.
4,226,190 A 10/1980 Ashton
4,582,003 A * 4/1986 Valero ..... 108/179
4,760,928 A * 8/1988 Bustos ..... 211/59.4
4,978,013 A * 12/1990 Hogg ..... 211/133.2
5,273,169 A * 12/1993 Maglione ..... 211/149
5,322,172 A * 6/1994 Maglione ..... 211/132.1
5,443,168 A * 8/1995 Dyment et al. ..... 211/149
5,458,411 A * 10/1995 Moss ..... 312/259
5,669,683 A * 9/1997 Moss et al. ..... 312/259
5,775,209 A 7/1998 Tiemann
5,899,345 A * 5/1999 Fuller et al. ..... 211/132.1
6,098,820 A * 8/2000 Smith ..... 211/132.1
6,145,794 A * 11/2000 Smith ..... 248/121
6,364,137 B1 4/2002 Glauth et al.
6,497,331 B1 12/2002 Morandi
6,659,294 B1 12/2003 Simard
6,752,280 B2 6/2004 Dye
6,915,916 B2 7/2005 Martins
7,007,615 B2 3/2006 Grueneberg
2006/0016774 A1 1/2006 Bustos
2006/0273055 A1 * 12/2006 Moss et al. ..... 211/135
2007/0175847 A1 8/2007 Prest

* cited by examiner

*Primary Examiner*—Jennifer E. Novosad
(74) *Attorney, Agent, or Firm*—H. Jay Spiegel

(57) ABSTRACT

A rack includes a rear wall and two side walls hinged to the rear wall to pivot toward one another when the rack is being collapsed. The side walls include brackets releasably supporting shelves. The shelves are made of metal wire and may be collapsed to a flat configuration and when erected, comprise a rectangular cubic structure. The rear wall has a bottom grid assembly pivotably mounted to the rear wall so that it may be pivoted downwardly when the rack is being opened and assembled, and may be pivoted upwardly to lie flat against the rear wall for storage and transport. The walls are made of a suitable wood or particle board material or lightweight metal.

19 Claims, 9 Drawing Sheets

COLLAPSIBLE RACK

BACKGROUND OF THE INVENTION

The present invention relates to a collapsible rack. In the prior art, racks designed to support a variety of items for display for a variety of purposes are well known. Some such racks are intended to be assembled once using fasteners such as screws, bolts, clips, and others. Other racks have been designed as knock-down items that may be assembled for temporary use and then disassembled for storage or transport. The present invention falls into the latter category.

In the prior art, while it is known to provide a rack that is easily collapsible for storage or transport, to date, Applicant is unaware of any such device in which the shelves are designed for ease of manufacture, the shelves are designed to be collapsible for easy transport, and the support structure for the shelves is also designed for easy erection, collapsing, storage, and transport.

Additionally, when a rack is to be used distant from a central office, for example, at a convention, it is sometimes inconvenient to bring tools along with the rack to facilitate its erection. Thus, it would be advantageous if such a rack were devised that included ease of transport in a small size, but also ease of assembly without the need for use of any tools. It is with these concepts in mind that the present invention was developed.

Applicant is aware of the following documents:

| U.S. patents | |
|---|---|
| 2,680,522 to Temple | 6,364,137 to Glauth et al. |
| 2,793,760 to Zel et al. | 6,497,331 to Morandi |
| 3,252,434 to Young, Jr. | 6,659,294 to Simard |
| 4,169,416 to Haynes et al. | 6,752,280 to Dye |
| 4,226,190 to Ashton | 6,915,916 to Martins |
| 4,978,013 to Hogg | 7,007,615 to Grueneberg |
| 5,775,209 to Tiemann | |

U.S. PATENT PUBLICATIONS

Publication No. US 2006/0016774 A1 to Bustos

Publication No. US 2007/0175847 A1 to Prest.

The above-listed Patents and Published Applications disclose a variety of different types of display racks, some of which are collapsible, and some of which disclose the ability to be assembled and disassembled without the use of tools. Some of these references include shelves that are made of metal wire structures, and others include sides and a back that are foldable for ease of storage and transport. However, none of the references, taken alone or in combination, teaches all of the aspects and features of the present invention as claimed hereinbelow.

SUMMARY OF THE INVENTION

The present invention relates to a collapsible rack. The present invention includes the following interrelated objects, aspects and features:

(1) In a first aspect, the inventive rack in its preferred embodiment includes a rear wall and two side walls hinged to the rear wall so that they may be pivoted toward one another when the rack is being collapsed.

(2) The inner faces of the side walls include brackets designed to releasably support shelves. The brackets include recesses with side edges of the shelves having protrusions designed to couple with the recesses to support the shelves in position.

(3) The shelves themselves are made of metal wire in the preferred embodiment of the present invention. The shelves are so constructed that when they are not in use, they may be collapsed to a substantially flat configuration and when erected, comprise a generally rectangular cubic structure encompassing several shelves. A plurality of shelf assemblies are preferably employed in the construction of the collapsible rack.

(4) In a preferred embodiment, the rear wall has a bottom grid assembly pivotably mounted thereto so that it may be pivoted downwardly when the rack is being opened and assembled, and may be pivoted upwardly to lie flat against the rear wall for storage and transport. The rear wall also includes reinforcing structure, preferably consisting of three vertical members, five cross members and two V-shaped braces.

(5) In the preferred embodiment, the side walls and rear wall are made of a suitable wood or particle board material or, alternatively, may be made of a lightweight metal. In the preferred embodiment, the side walls subtend less than half the width of the rear wall so that they may be folded together with their upper portions not overlapping. In one preferred construction, the side walls have lower portions that extend in a forward direction triangularly. When the side walls are pivoted toward the rear wall, the distal edges of the side walls with respect to the rear wall may overlap.

Accordingly, it is a first object of the present invention to provide a collapsible rack.

It is a further object of the present invention to provide such a rack in which side walls are hingedly connected to a rear wall.

It is a further object of the present invention to provide such a device in which side walls may be pivoted to lie against the rear wall for ease of storage and transport.

It is a still further object of the present invention to provide such a device further including a bottom grid assembly that may be pivoted against the rear wall for storage and transport and which may be pivoted downwardly to lie generally orthogonal to the rear wall during assembly to assist in bracing the side walls in position.

It is a still further object of the present invention to provide such a device in which the shelves are made of metal wire and are constructed for ease of assembly to the side and rear walls of the rack.

It is a still further object of the present invention to provide such a device in which the shelves are made in such a manner that a plurality of shelves may be collapsed to a generally flat configuration for ease of storage and transport.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
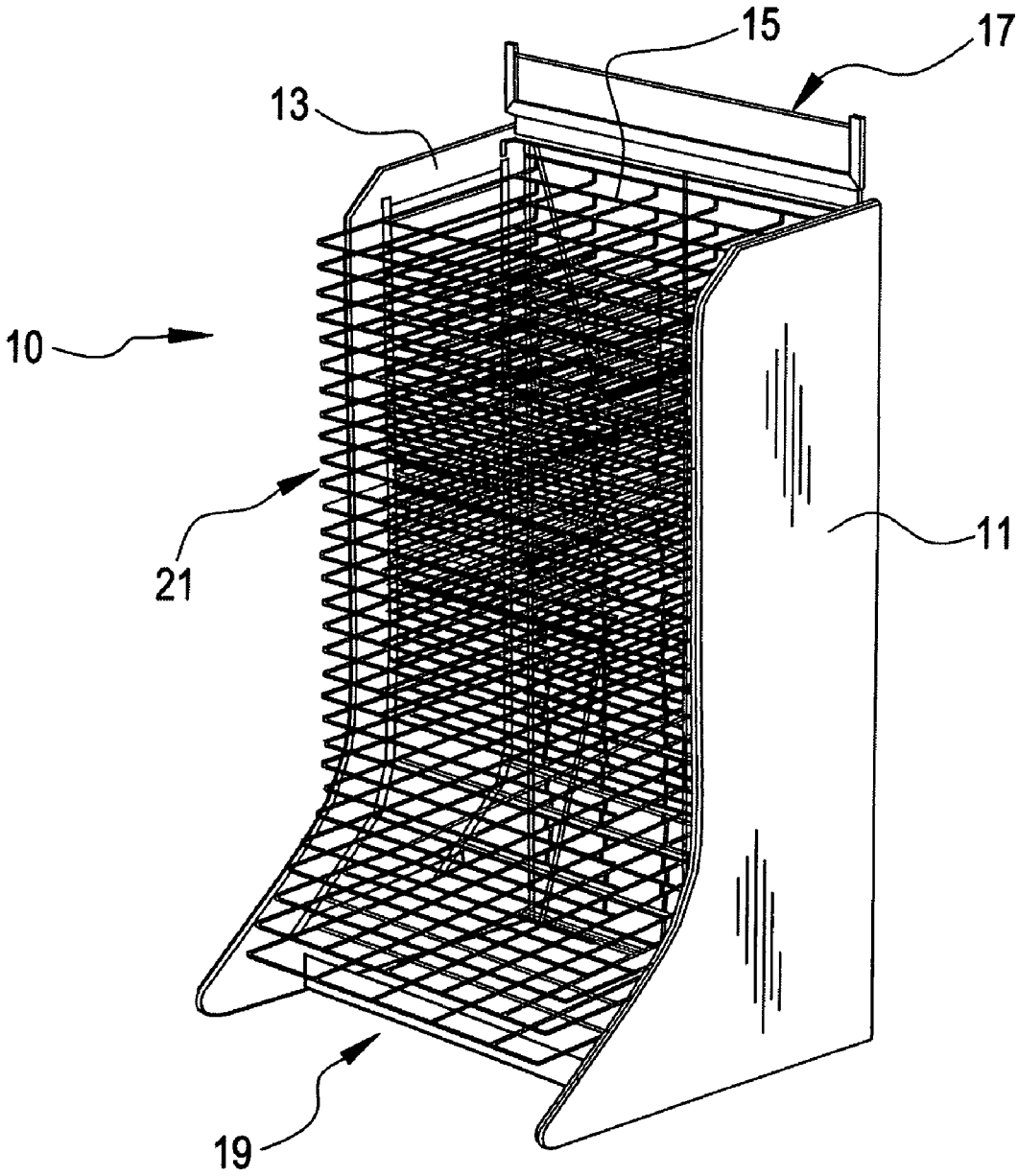
FIG. 1 shows a side perspective view of a preferred embodiment of the present invention as assembled and ready for use.

With reference, first, to FIG. 1, the present invention is generally designated by the reference numeral 10 and is seen to include side walls 11 and 13, and a rear wall 15 with opposed side edges to which the side walls 11 and 13 are hingedly or pivotably mounted to move between a first position (FIG. 16) substantially parallel to the rear wall 15 and a second position (FIG. 19) substantially orthogonal thereto. A header assembly 17 is preferably mounted on the top of the top hinges affixed to the side walls and a bottom grid assembly 19 is pivotably mounted at the bottom of the rear wall 15 in a manner to be described in greater detail hereinafter. Shelves are generally designated by the reference numeral 21 in FIG. 1.

Figure 2:
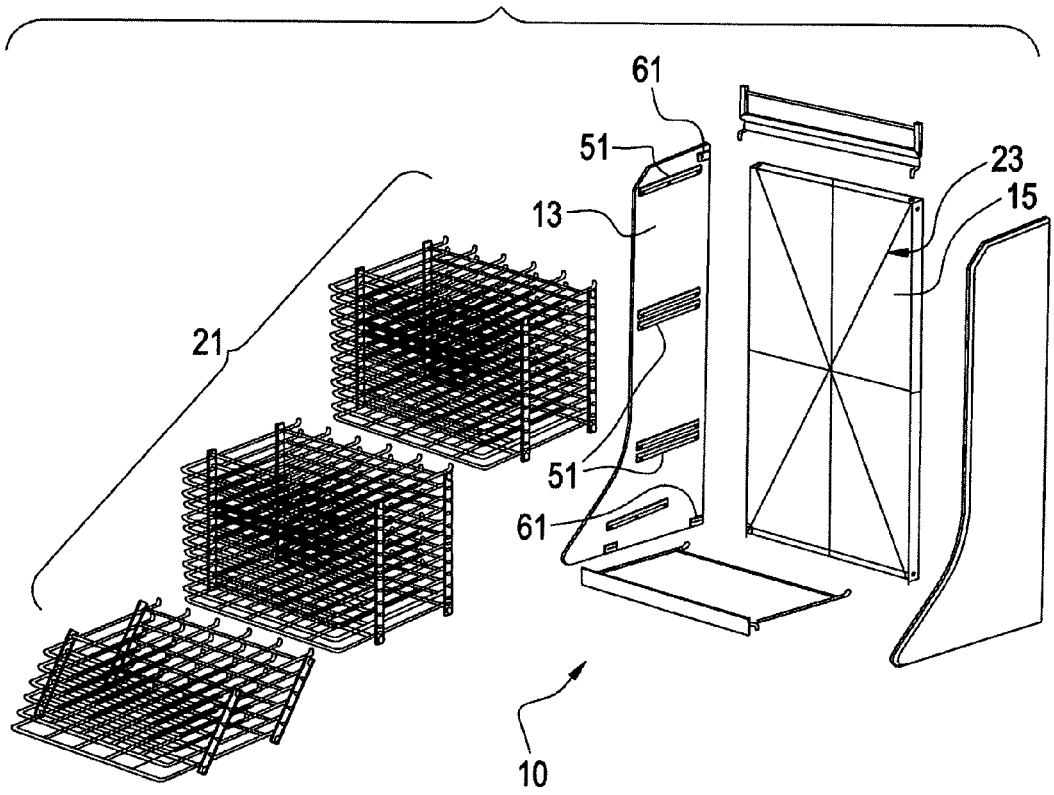
FIG. 2 shows an exploded perspective view of the invention illustrated in FIG. 1.
Figure 7:
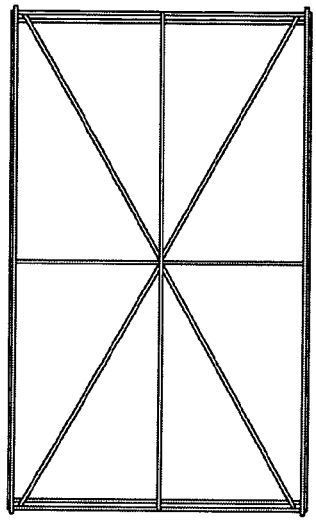
FIG. 7 shows a front view of an inner face of a rear wall of the present invention.
Figure 8:
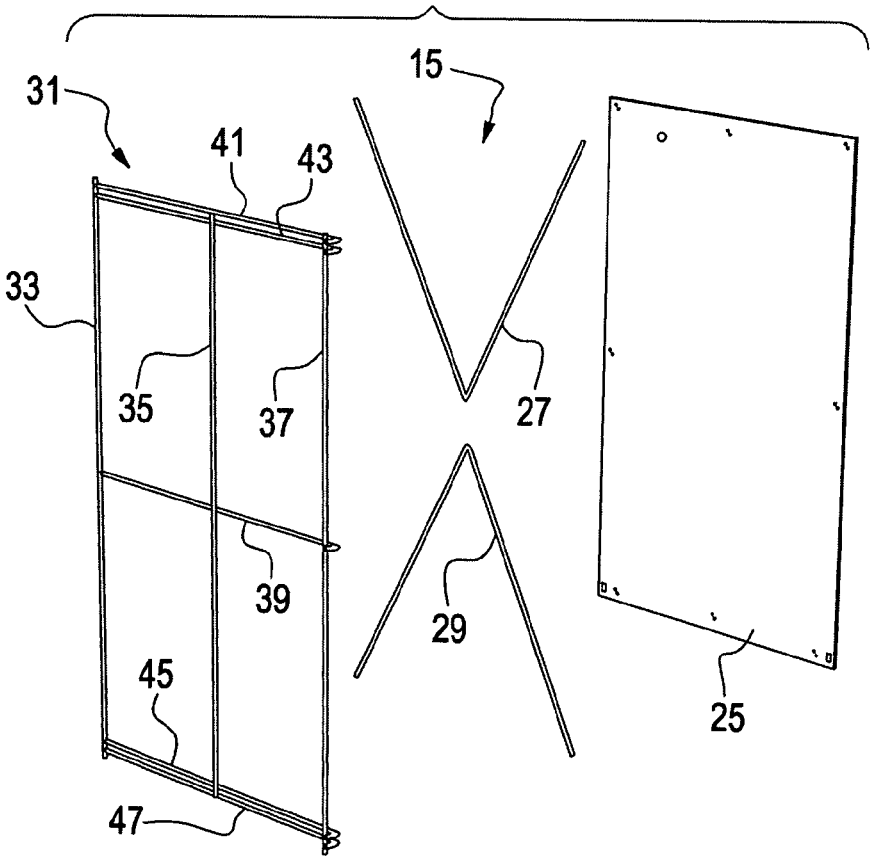
FIG. 8 shows an exploded perspective view of the rear wall of FIG. 7.

Reference is now made to FIG. 2 which shows an exploded perspective view of the collapsible rack 10. As clearly seen in FIG. 2, the rear wall 15 includes bracing generally designated by the reference numeral 23 and described in more detail with reference to FIG. 7. As shown in FIG. 7, the rear wall 15 consists of a generally rectangular plate 25 preferably made of corrugated plastic, two V-shaped wire-like braces 27 and 29, and a grid 31 consisting of parallel pieces 33, 35 and 37, a perpendicular piece 39, upper horizontal pieces 41 and 43, and lower horizontal pieces 45 and 47.

Figure 3:
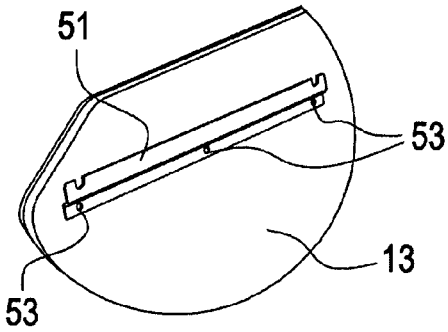
FIG. 3 shows a close-up view of a portion of a side wall of the present invention.
Figure 5:
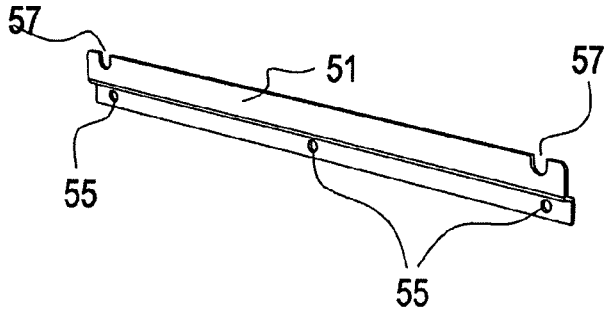
FIG. 5 shows a side perspective view of an embodiment of a bracket assembled to each side wall.

The side wall 13 as shown in FIG. 2 has a plurality of brackets 51 that are designed to releasably retain the shelves 21. With reference to FIG. 3, one of the brackets 51 is shown with details of its manner of mounting. As shown, the bracket 51 comprises an elongated member, and fasteners 53 extend through holes in the elongated bracket 51 and fasten the bracket 51 to the side wall 13. With further reference to FIG. 5, the holes are designated by the reference numeral 55 and the bracket 51 also includes two arcuate recesses 57, one at each end thereof. These recesses are provided for a purpose to be described in greater detail hereinafter.

Figure 6:
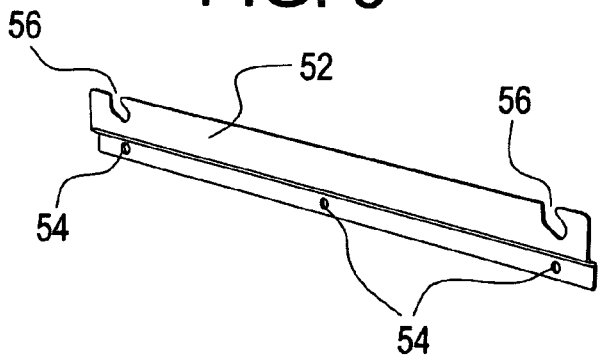
FIG. 6 shows an alternative construction for a bracket assembled to a side wall intended to better prevent accidental dislocation of the shelves.

FIG. 6 shows an alternative construction of the bracket 51 with the bracket in FIG. 6 designated by the reference numeral 52, and including holes 54 corresponding to the holes 55 and including J-shaped slots 56 that permit a more secure reception of structures of the shelves as will be described in greater detail hereinafter.

Figure 4:
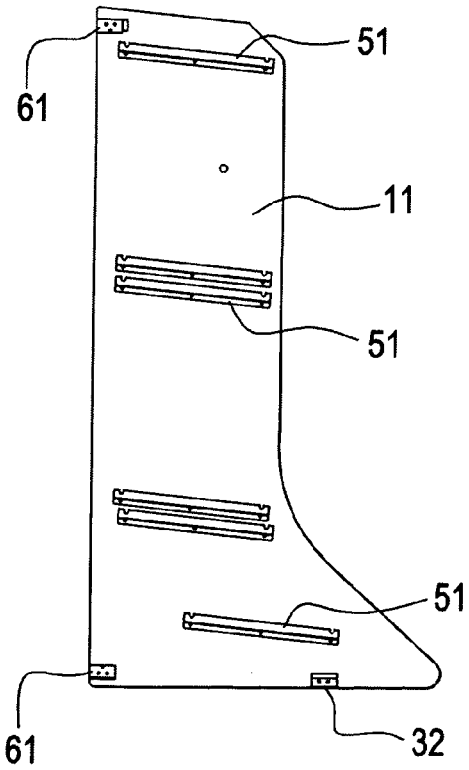
FIG. 4 shows a side view of one of the side walls of the present invention, showing the inner face of that side wall.

FIG. 4 shows the side wall 11 and shows it to include brackets 51 like those shown in FIG. 2 for the side wall 13. FIG. 4 also shows the hinges 61 used to hingedly mount the side wall 11 on the rear wall 15. Similar hinges are provided on the side wall 13 as shown in FIG. 2. The upper ones of the hinges 61 support the header assembly 17.

Figure 9:
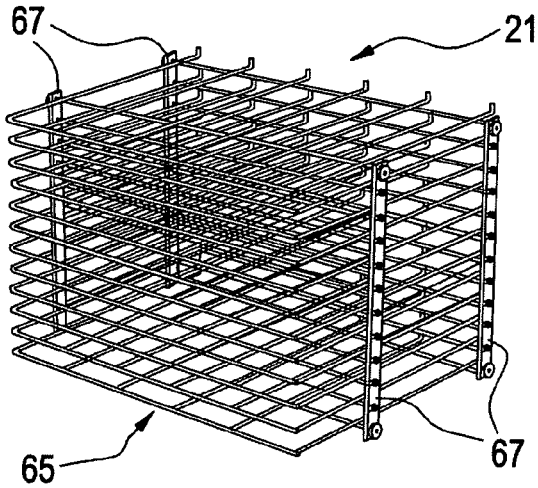
FIG. 9 shows a perspective view of a shelving system of the present invention.
Figure 10A:
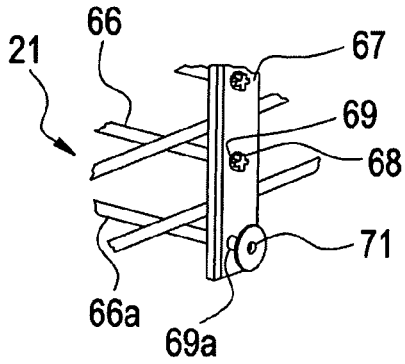
FIG. 10*a* shows a close-up perspective view of a portion of the structure shown in FIG. 9 with details shown of a weld nut creating a flange designed to hang the shelves on a bracket such as is illustrated in FIGS. 5 and 6.
Figure 10B:
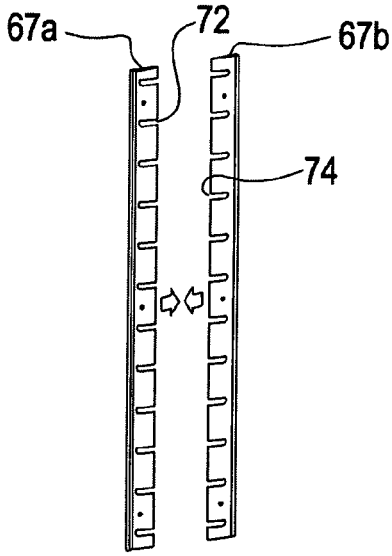
FIG. 10*b* shows a perspective view of gripper bar halves shown in FIG. 10*a*.
Figure 10C:
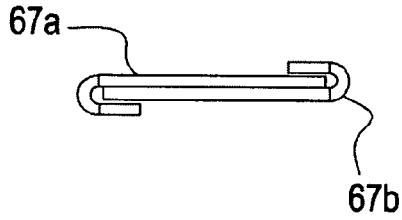
FIG. 10*c* shows a top view of gripper bar halves assembled together to form a gripper bar.
Figure 11:
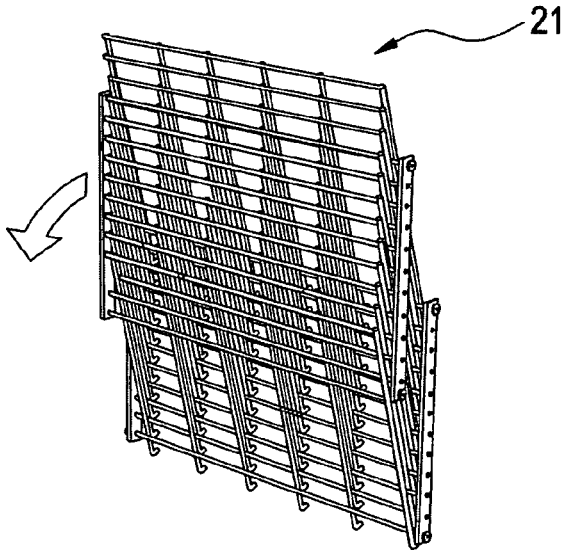
FIG. 11 shows the shelves of FIG. 9, but in a collapsed configuration for easy storage and transport.

With reference, now, to FIGS. 9, 10 and 11, the details of the shelving or shelves 21 will now be described. As seen in FIG. 9, each set of shelves 21 comprises a module having a plurality of sets of crossed wires in parallel planes. The wires are generally designated by the reference numeral 65 and the spacing between the respective shelves is maintained by a series of gripper bars 67, two of which are located on each side of the shelves. With reference to FIG. 10*a*, an enlarged view of a bottom of one of the gripper bars 67 shows openings 69 that receive side extensions or ends of wires 66 forming the shelves, with the wire ends crimped at 68 at two spaced locations inside and outside the gripper bars 67, to (1) retain the wires 66 extending through the openings 69, and (2) hold the gripper bars in position between the crimped locations.

The wire 66*a* at the bottom (FIG. 10) extends through an opening 69A and, instead of being crimped, has a disc-like flange 71 welded to or threaded on its end in a manner spaced from the bar 67 as shown. The flanges 71 are designed to be received within the recesses 57 (FIG. 5) or 56 (FIG. 6) to retain the shelves 21 on the brackets 51, 52, respectively. The recesses 56 are angled to provide a locking feature preventing accidental dislocation of the shelves.

With reference to FIG. 10*b*, each gripper bar 67 is made up of two identical gripper bar halves 67*a* and 67*b*, each of which has a J-shaped cross section (see FIG. 10*c*). The halves 67*a* and 67*b* are oriented oppositely so that they interlock together and are retained together by rivets (not shown). The gripper bar half 67*a* has a plurality of slots 72 aligned with respective slots 74 in the gripper bar half 67*b* when the halves 67*a* and 67*b* are assembled together. As should be understood from FIGS. 10*a-c*, each pair of slots 72 and 74 captures therebetween one of the wires 66 between the two crimped portions 68 thereof to mount the gripper bars 67 thereto.

FIG. 9 shows a shelf module in its first configuration. As seen in FIG. 11, when it is desired to take apart the collapsible rack 10, the shelving 21 may be flattened to a second configuration for storage by pivoting the wires 66 by moving the gripper bars 67 in the front upward with respect to the gripper bars 67 in the rear as shown in FIG. 11.

Figure 12:
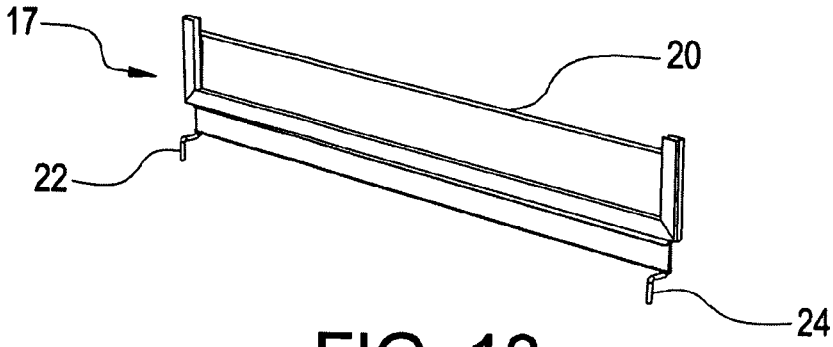
FIG. 12 shows a perspective view of a header assembly of the present invention.
Figure 13:
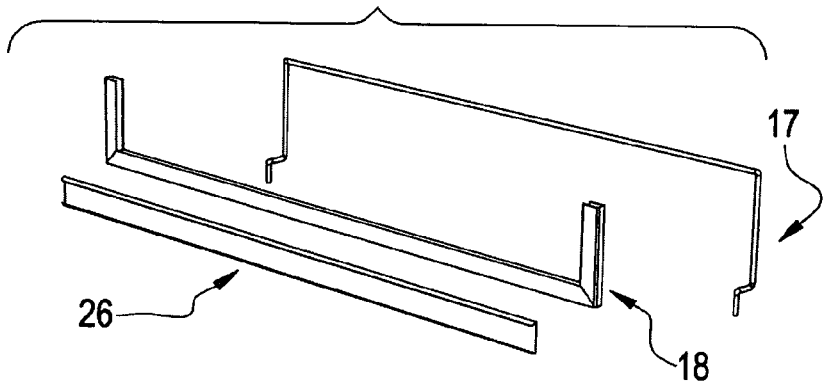
FIG. 13 shows an exploded perspective view of the header assembly of FIG. 12.

FIGS. 12 and 13 show the details of the header assembly 17. As shown, the header 17 includes a U-shaped header graphic channel 18 designed to receive advertising copy, and a header wire 20 attached to the header graphic channel 18, and including lower tangs 22 and 24 removably received within receiver tubes (not shown) welded to top ones of the hinges 61 fastened to the side walls 11 and 13 to removably mount the header assembly thereon. A tag channel 26 is mounted below the header graphic channel 18 and may receive additional signage.

Figure 14:
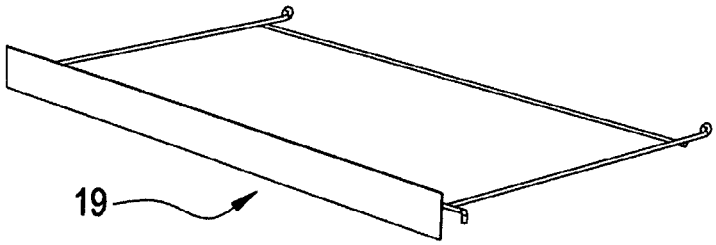
FIG. 14 shows a perspective view of a bottom grid assembly of the present invention.
Figure 15:
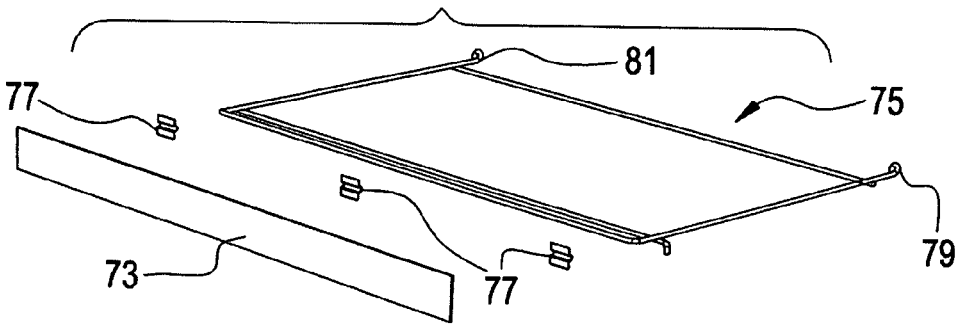
FIG. 15 shows an exploded perspective view of the bottom grid assembly of FIG. 14.
Figure 18:
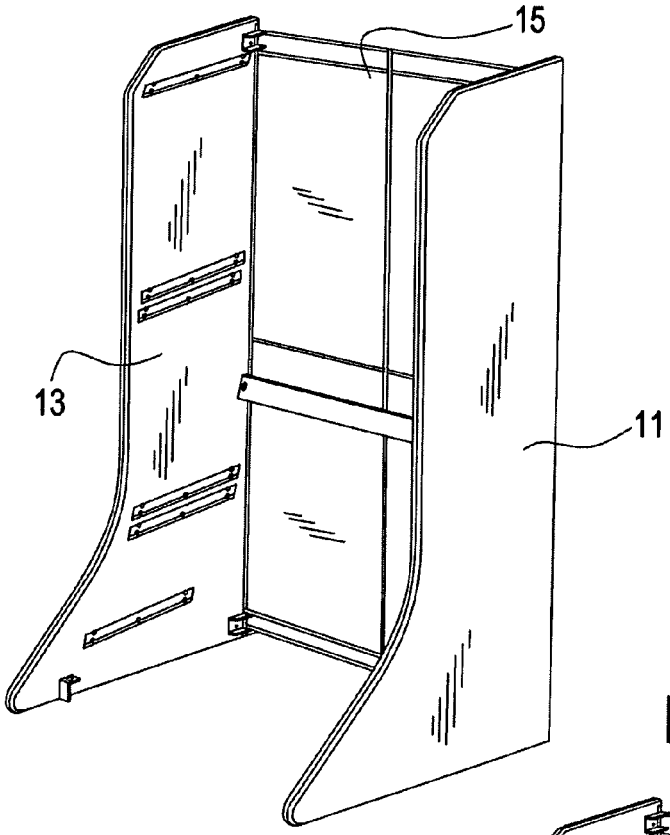
FIG. 18 shows both side walls pivoted away from the rear wall.

With reference to FIGS. 14 and 15, locking means comprising the bottom grid assembly 19 is seen to include a kick plate 73 and a bottom grid wire 75, to which the kick plate 73 is permanently attached through the use of the loop straps 77 which permit the kick plate to pivot flat against the bottom grid in a common plane for storage. The bottom grid wire has proximal ends formed in loops 79 and 81. The loops 79 and 81 encircle the horizontal piece 45 of the grid 31 and thereby mount the bottom grid assembly at the lower end of the rear wall 15. This mounting permits the bottom grid assembly to pivot upwardly to a second position as shown in FIG. 18 when the inventive rack 10 is being stored or transported and to pivot down to the first position as shown in FIG. 1 when it is in use. The bottom grid assembly, in use, as shown in FIG. 1, locks the positions of the side walls 11 and 13 with respect to the rear wall (FIG. 19) with side edges of the bottom grid assembly engaging respective ones of the side walls. In this regard, with reference to FIG. 4, a kick bracket 32 is mounted on the side wall 11 and a corresponding kick bracket is mounted in a corresponding location in the side wall 13. These kick brackets receive side wire portions of the bottom grid assembly to retain it in the down position.

Figure 16:
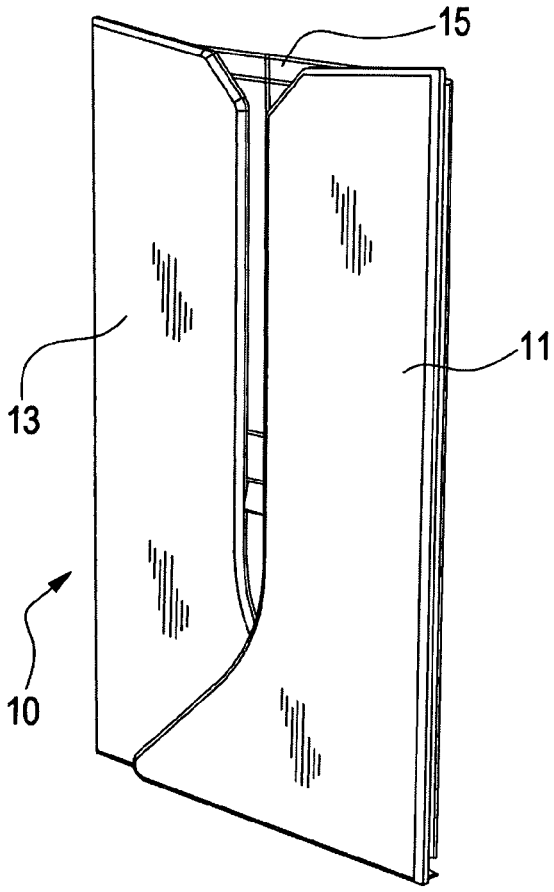
FIG. 16 shows a perspective view of the rack with the shelves removed, the bottom grid assembly folded up, and the side walls folded toward the rear wall.
Figure 17:
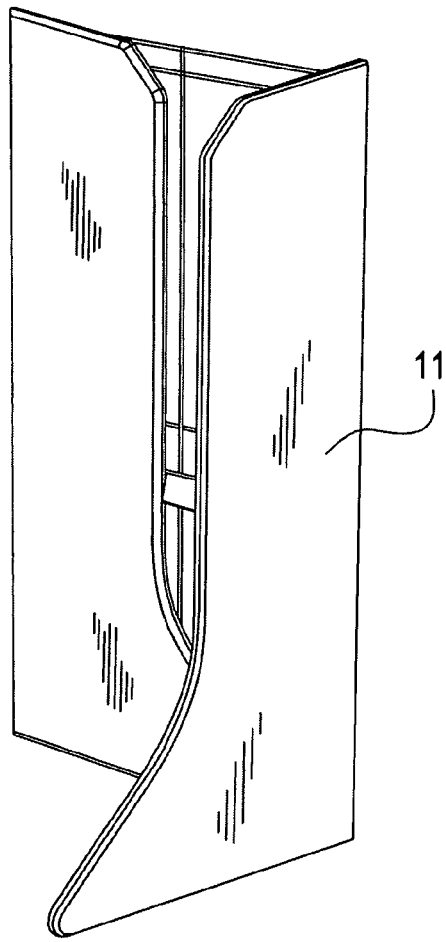
FIG. 17 shows one side wall pivoted away from the rear wall.
Figure 19:
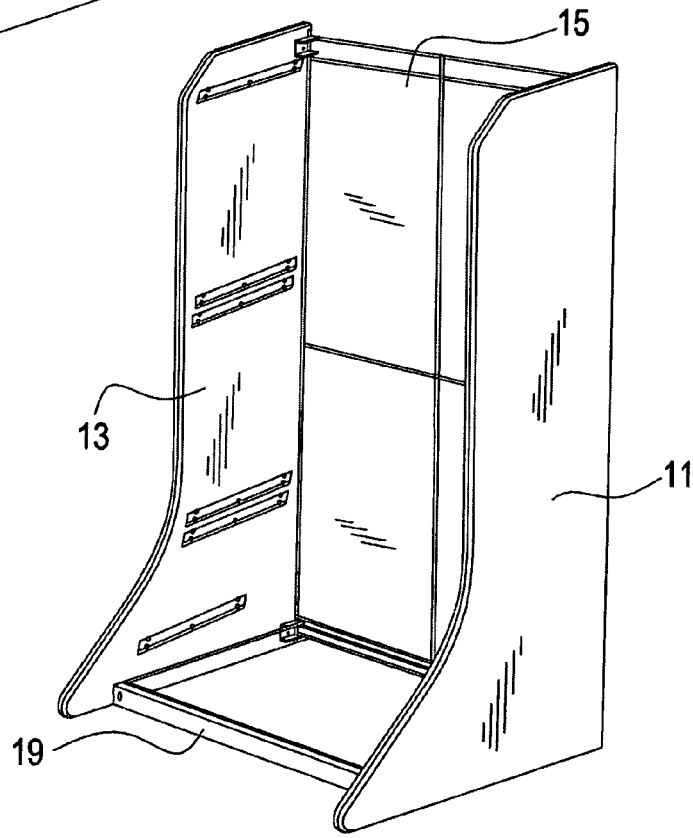
FIG. 19 shows the bottom grid assembly pivoted downwardly as compared to its position from FIG. 18 and used to retain the open configuration of the side walls with respect to the rear wall.
Figure 20:
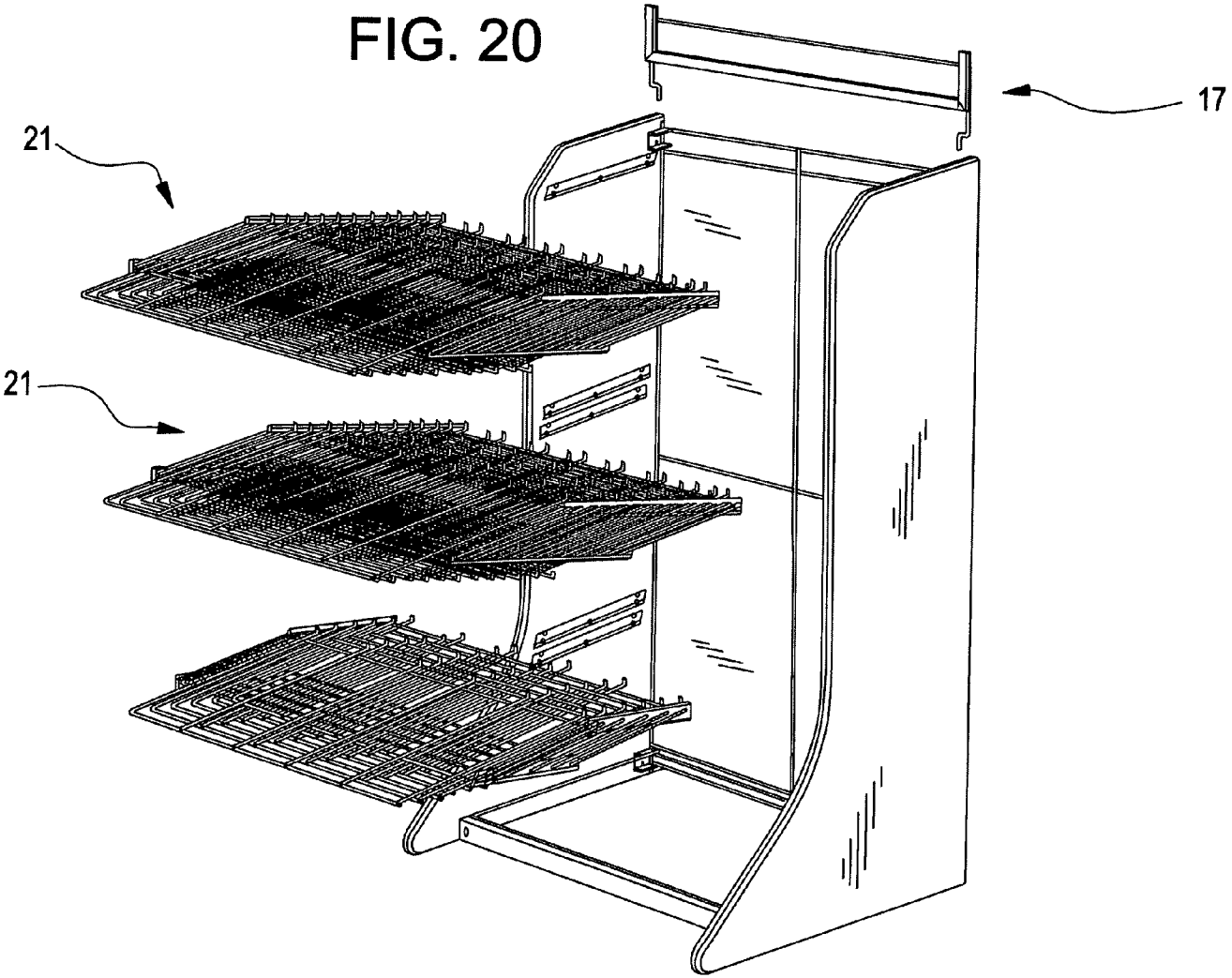
FIG. 20 shows an exploded perspective view of the inventive rack with three shelving systems in the process of being installed thereon.

With reference to FIGS. 16-20, with the above description in mind, the operation of the present invention will now be explained. With reference to FIG. 16, the inventive rack 10 is seen with the side walls 11 and 13 collapsed next to the rear wall 15 for storage and transport. As seen, the side walls have widths slightly longer than half the width of the rear wall so they overlap. In FIG. 17, the wall 11 has been pivoted outwardly and in FIG. 18, the walls 11 and 13 are shown pivoted outwardly. FIG. 19 shows the bottom grid assembly 19 pivoted downwardly to a position locking the positions of the side walls 11 and 13 with respect to the rear wall 15. FIG. 20 shows the header assembly 17 and the shelves 21 in exploded views depicting them as they are being installed.

In order to break down the inventive rack 10, the sequence of events shown in FIGS. 16-20 is reversed.

In the preferred embodiment of the present invention, the walls 11, 13 and 15 are made of any suitable material such as wood, metal, wire or some combination thereof. It is preferred that the shelves 21 be made of a metallic wire material. The type of metal employed may depend upon the desired strength as well as the weight requirements or limitations.

The present invention provides significant improvements over the prior art. The components of the present invention are easily manufactured. Multiple shelves are mechanically fastened together through the use of a gripper bar system. This eliminates the need to weld adjacent shelves together.

The ability of the inventive rack to collapse to small size saves shipping costs. Once the shelves are ganged together, they can be folded flat eliminating any space between the shelves to reduce shipping volume.

The entire rack 10 may easily be installed without the need to use any tools. The flanges welded or otherwise attached on the lower wires of the shelves facilitate ease of installation and disassembly.

In the preferred embodiment of the present invention, any desired articles of manufacture may be easily stored on the shelves thereof. One example of an intended use of the present invention consists of the provision of shelving for the purpose of displaying carpet samples. Such a display is easily provided in a retail store establishment or at a convention or other show wherein it is desirable and necessary to quickly assemble and disassemble displays.

Accordingly, an invention has been disclosed in terms of a preferred embodiment thereof which fulfills each and every one of the objects of the invention as set forth hereinabove, and provides a new and useful collapsible rack of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A collapsible rack comprising:

a) a rear wall having two opposed side edges, each side edge having a side wall pivotably mounted thereto, each side wall being pivotable between a first position substantially parallel to said rear wall and a second position substantially orthogonal to said rear wall;

b) locking means selectively movable to a first position for engaging and locking said side walls in said second position thereof and selectively movable to a second position permitting said side walls to be pivoted to said first position thereof;

c) at least one bracket on each side wall; and d) shelving releasably retained on said brackets, said shelving comprising a plurality of shelves included in a single module and said shelves made of wire, each shelf comprising a plurality of crossed wires, said module including a first configuration in which said shelves are erected and a second configuration in which said module is substantially flat for easy storage, said shelves pivoting in transforming said module from said first configuration to said second configuration, and vice-versa.

2. The rack of claim 1, wherein said locking means is pivotably mounted adjacent a lower edge of said rear wall and movable between a first position lying flat against said rear wall and a second position substantially orthogonal to said rear wall.

3. The rack of claim 2, wherein said locking means includes side edges, in said second position of said locking means, said side edges thereof engage respective ones of said side walls to lock each of said side walls in said second position thereof.

4. The rack of claim 3, wherein said locking means comprises a bottom grid assembly including a kick plate.

5. The rack of claim 4, wherein said kick plate is pivotably connected to a bottom grid wire such that in said first position of said locking means, said kick plate may be pivoted to lie in a common plane with said bottom grid wire.

6. The rack of claim 5, wherein said rear wall includes a reinforcing grid including a horizontally disposed piece, said bottom grid being pivotably mounted on said piece.

7. The rack of claim 1, wherein said brackets comprise elongated members horizontally fastened to said side walls and including upwardly facing openings sized and configured to releasably receive fastening portions of said brackets.

8. The rack of claim 7, wherein said openings are arcuate.

9. The rack of claim 7, wherein said openings are J-shaped slots.

10. The rack of claim 7, wherein said fastening portions comprise discs fastened to side extensions of said shelves.

11. The rack of claim 10, wherein said side extensions of said shelves comprise wires extending through openings in gripper bars on each side of said shelves.

12. The rack of claim 10, wherein each gripper bar comprises a pair of gripper bar halves clamped about said side extensions of said shelves.

13. The rack of claim 1, wherein said side walls have widths slightly longer than half a width of said rear wall, whereby in said first position of said side walls, they overlap.

14. The rack of claim 1, devoid of fasteners, whereby said rack may be erected and collapsed without use of any tools.

15. The rack of claim 1, further including a header mounted with a graphic channel suspended above said rear wall and adapted to receive advertising copy.

16. A collapsible rack comprising:

a) a rear wall having two opposed side edges, each side edge having a side wall pivotably mounted thereto, each side wall being pivotable between a first position substantially parallel to said rear wall and a second position substantially orthogonal to said rear wall;

b) locking means selectively movable to a first position for engaging and locking said side walls in said second position thereof and selectively movable to a second position permitting said side walls to be pivoted to said first position thereof, said locking means comprising a bottom grid assembly including a kick plate, said kick plate being pivotably connected to a bottom grid wire such that in said first position of said locking means, said kick plate may be pivoted to lie in a common plane with said bottom grid wire;

c) at least one bracket on each side wall; and d) shelving releasably retained on said brackets, said shelving comprising a plurality of shelves included in a single module, said module including a first configuration in which said shelves are erected and a second configuration in which said module is substantially flat for easy storage, said shelves pivoting in transforming said module from said first configuration to said second configuration, and vice-versa.

17. The rack of claim 16, wherein said bottom grid assembly is pivotably mounted adjacent a lower edge of said rear wall and movable between a first position lying flat against said rear wall and a second position substantially orthogonal to said rear wall, and said bottom grid assembly including side edges, in said second position of said bottom grid assembly, said side edges thereof engaging respective ones of said side walls to lock each of said side walls in said second position thereof.

18. The rack of claim 17, wherein said rear wall includes a reinforcing grid including a horizontally disposed piece, said bottom grid assembly being pivotably mounted on said piece.

19. The rack of claim 16, wherein said side walls have widths slightly longer than half a width of said rear wall, whereby in said first position of said side walls, they overlap, said rack being devoid of fasteners, whereby said rack may be erected and collapsed without use of any tools.

* * * * *